US005730330A

United States Patent [19]

Reading

[11] Patent Number: 5,730,330

[45] Date of Patent: Mar. 24, 1998

[54] LIQUID DISPENSING APPARATUS INCLUDING VISUALLY STIMULATING SYRUP DISPLAY TUBES

[76] Inventor: Graeme John Reading, 9B Crane Court, 45 Sasson Road, Hong Kong, Hong Kong

[21] Appl. No.: 508,468

[22] Filed: Jul. 31, 1995

[30] Foreign Application Priority Data

Jun. 15, 1995 [GB] United Kingdom ..... 9512210

[51] Int. Cl.[6] ..... B65D 5/66

[52] U.S. Cl. ..... 222/113; 222/129.1; 222/159

[58] Field of Search ..... 222/129.1, 113, 222/159, 154, 158, 64, 192, 318, 144.5, 23; 40/406, 407

[56] References Cited

U.S. PATENT DOCUMENTS

| | | | |
|---|---|---|---|
| 191,346 | 5/1877 | Johnson | 40/407 |
| 886,882 | 5/1908 | Smith | 222/158 |
| 1,024,515 | 4/1912 | Lippincott | 222/129.1 |
| 1,398,348 | 11/1921 | Weber et al. | 222/129.1 |
| 1,505,435 | 8/1924 | Schatz | 222/129.1 |
| 1,754,531 | 4/1930 | Stanford et al. | 40/406 |
| 1,780,687 | 11/1930 | Smith | 222/113 |
| 4,291,693 | 9/1981 | Todd et al. | 222/159 |

*Primary Examiner*—Philippe Derakshani
*Attorney, Agent, or Firm*—Thompson Hine & Flory LLP

[57] ABSTRACT

Liquid dispensing apparatus includes a source of supply of carbonated water, a source of supply of one or more beverages in syrup form and a mixer for admixture of the water and syrup. Prior to admixing of the carbonated water and syrup the apparatus displays a flowing sample of the syrup. The apparatus may include a plurality of different syrups, each with its own display. The display preferably takes the form of a display dispense line comprising an illuminated translucent or transparent tube bent in a tortuous path. The displayed syrup sample may be either mixed and dispensed after display, returned to a main reservoir or be retained as a sample for display only.

15 Claims, 4 Drawing Sheets

LIQUID DISPENSING APPARATUS INCLUDING VISUALLY STIMULATING SYRUP DISPLAY TUBES

BACKGROUND OF THE INVENTION

This invention relates to a liquid dispensing apparatus and more particularly to a vending apparatus for dispensing potable liquids such as carbonated beverages.

So-called post-mix apparatus is known in which carbonated water is mixed with a flavored syrup at a dispensing nozzle and directed into a cup or similar liquid container. The apparatus may be fully automatic in operation or the dispensing operation can be manually controlled. In either case operation can be inhibited unless a coin, token, coded card or similar device is used to authorize operation. It is common for a single dispensing nozzle to provide a plurality of flavored beverages by selection of the syrup which is mixed with the carbonated water. The latter may be stored in precarbonated form or carbonated in situ by a mixing valve which combines high pressure carbon dioxide gas with cooled water flowing from a main supply or reservoir. The operation of most liquid dispensers of this type is unimpressive visually and seldom attracts attention as the various functions performed when dispensing a beverage occur inside an enclosed cabinet.

SUMMARY OF THE INVENTION

The present invention provides a liquid dispensing apparatus which attracts the attention of anyone in its proximity and stimulates further use by the viewers and their companions.

According to the present invention there is provided a liquid dispensing apparatus including a source of carbonated water, a source of the supply of one or more beverages in syrup form and a mixer for the admixture of the water and syrup, characterized in that prior to admixture the apparatus displays a flowing sample of syrup.

In a preferred embodiment a sample of syrup is directed through a display dispense line comprising a transparent or translucent tube. The tube surface may carry markings such as pigmented stripes or embossed patterns. In many embodiments the display dispense line is illuminated. The tube should have a sufficiently small caliber that the sample is seen as an elongate strip which moves along the tube from an issue point to a reception point when a beverage is dispensed. A linear tube may used or, in a preferred embodiment, the tube provides a serpentine, zig zag or other tortuous path to act as a focus of attention. The flow of the syrup can be made clearly visible by rear illumination and/or fabricating the tube with a contour causing optical magnification of the contents when viewed externally.

The displayed syrup sample will generally not be the sample being dispensed at that moment but a sample of a similar or identical syrup drawn from and, optionally, returned to the syrup reservoir without reaching the dispensing nozzle. The displayed syrup sample will be used later in a subsequent dispensing cycle.

The apparatus according to the invention comprises a known type of post mix liquid dispensing system which comprises sources of potable water, high pressure carbon dioxide, flavored syrups and, optionally, ice. The outputs from the sources are mixed in appropriate ratios and dispensed at controlled syrup concentrations by known mixing valves and controlled volume dispensers into a manually or automatically located cup, glass or similar container. The apparatus further comprises one or more display dispense lines, a syrup reservoir and a controlled source of gas adapted to drive a sample of syrup from the reservoir into and through the display dispense lines whenever the dispensing apparatus is operated. The sample is seen to flow from the issue point to the reception point where it disappears from view. The viewer may gain the impression that the sample seen is that included in the dispensed beverage.

Where the apparatus is capable of supplying a variety of syrups, there are separate display dispense lines for each syrup to prevent cross contamination. The separate lines may be interwoven or cross each other to enhance the aesthetic effect. Illumination of the display dispense lines may include a source of ultra-violet radiation to activate any fluorescent components in the display sample such as quinine in tonic water. Although most flavor syrups include natural or synthetic colorants these may not be present in sufficient quantity to provide a spectacular display. In one form of the invention a sample of highly colored or fluorescent display syrup is directed through the display lines while a beverage is being dispensed.

BRIEF DESCRIPTION OF THE DRAWINGS

In order that the invention may be clearly understood it will now be described with reference to the accompanying drawings in which.

DETAILED DESCRIPTION

Figure 1:
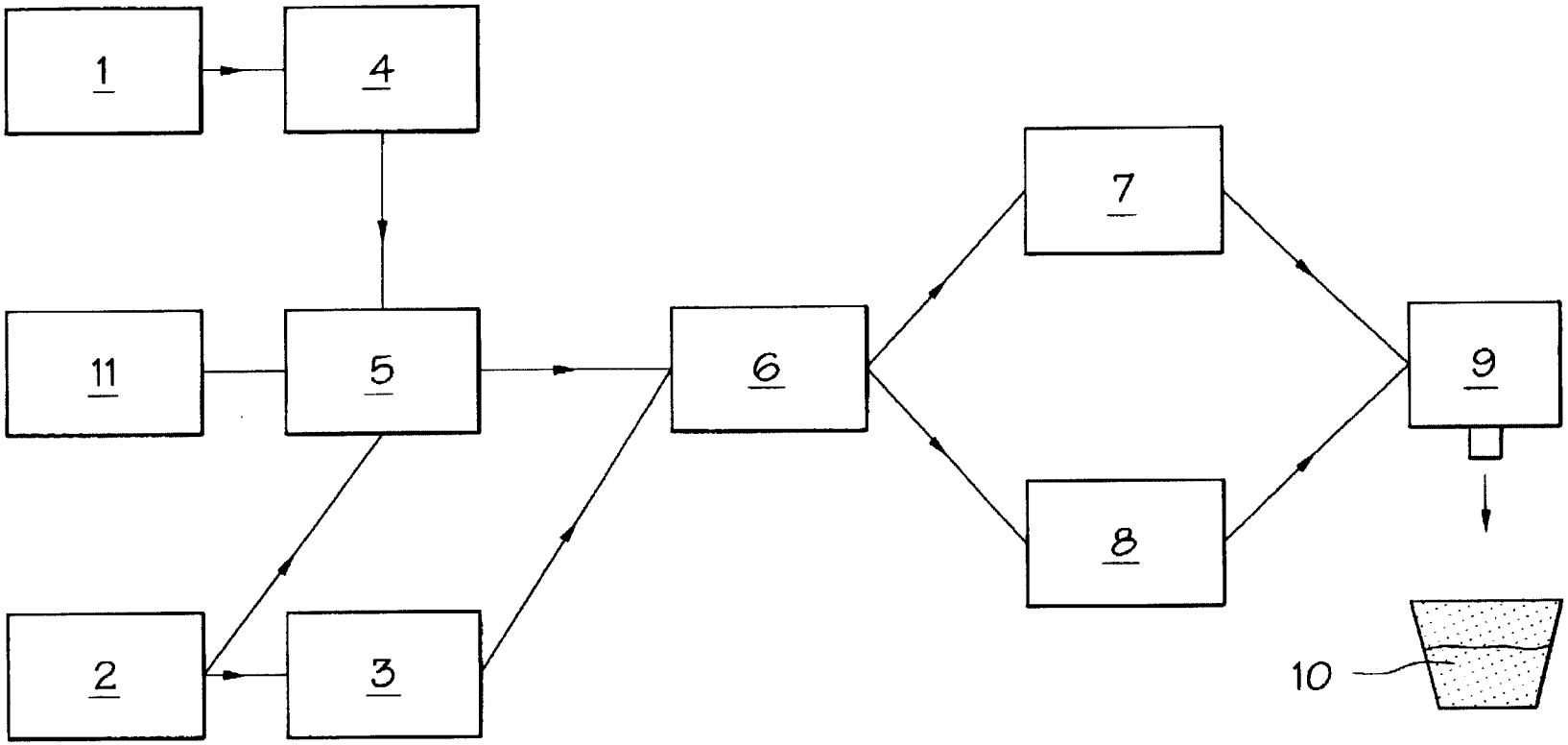
FIG. 1 is a flow chart of fluid dispensing apparatus according to the prior art.

A conventional fluid dispensing apparatus, see FIG. 1, consists of a source of potable water 1, a source of high pressure carbon dioxide gas 2 and a source of flavored syrup 3. Water from the source 1 flows through a filter 4 to a carbonator unit 5 in which it is mixed with gas from the source 2 in a manner which causes the gas to be absorbed within the water. The carbonated water so formed flows through a refrigeration unit 6 to a water flow control valve 7. Syrup from the source 3 flows through the refrigeration unit 6, without mixing with the carbonated water from the unit 5, to a syrup flow control valve 8. The syrup is caused to flow from the source 3 by gas pressure from the source 2 controlled by valve means (not shown). The apparatus is also capable of providing a plurality of syrup sources 3 and a corresponding plurality of display dispense lines 12; where there is provided a separate display dispense line 12 for each syrup source 3 to prevent cross contamination.

When a beverage is required to be dispensed the valves 7 and 8 are opened so that carbonated water and syrup flow into an opened mixing valve 9 and out to a fluid container shown as a glass 10. The operation of the units 5 and 6 together with the valves 7, 8 and 9 is powered and controlled by a source of electrical power 11 which includes appropriate control circuitry. A beverage, consisting of a mixture of cooled carbonated water and syrup, will normally be dispensed when the control system is activated by an authorizing signal from a coin, card or other security device (not shown). Alternatively the control system may be manually activated by a manual control lever or portion control push button system.

Figure 2:
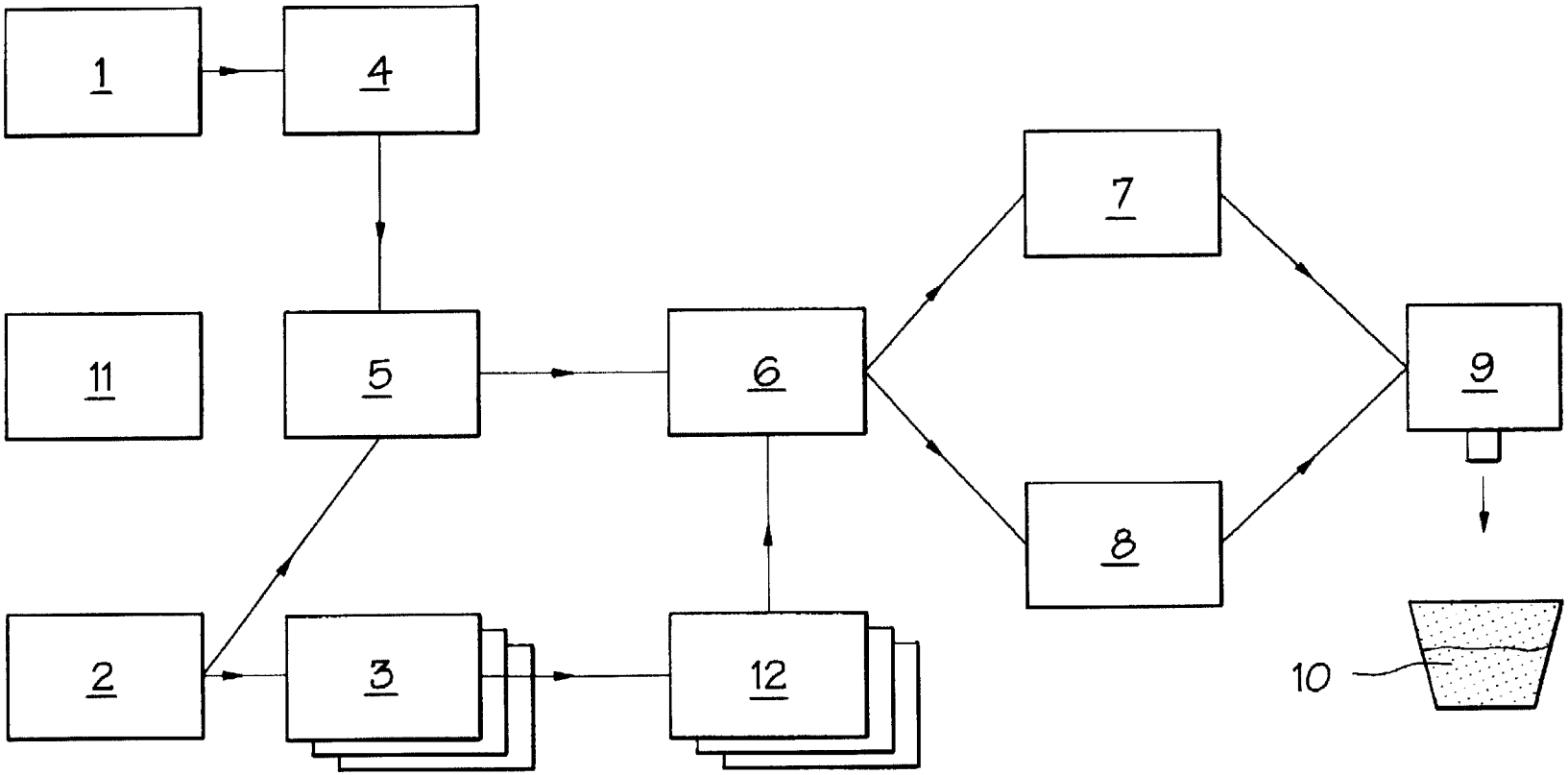
FIG. 2 is a flow chart of fluid dispensing apparatus according to the invention.

One form of a fluid dispensing apparatus according to the invention, see FIG. 2, includes all the items required by a conventional fluid dispensing apparatus together with one or more display dispense lines 12 located between the syrup source 3 and the unit 6. When syrup flows from the source 3 to the unit 6 it is displayed as it passes through the lines 12. Discrete samples of syrup are seen to pass through the lines 12 whenever the dispensing apparatus is operated. Although the displayed syrup sample may ultimately be mixed with carbonated water and dispensed, the length of the fluid path from the lines 12 to the valve 9 is too long for the displayed sample to reach the valve during a dispensing cycle. However the viewer may gain the impression that the displayed sample is the one included in the dispensed beverage.

Figure 3:
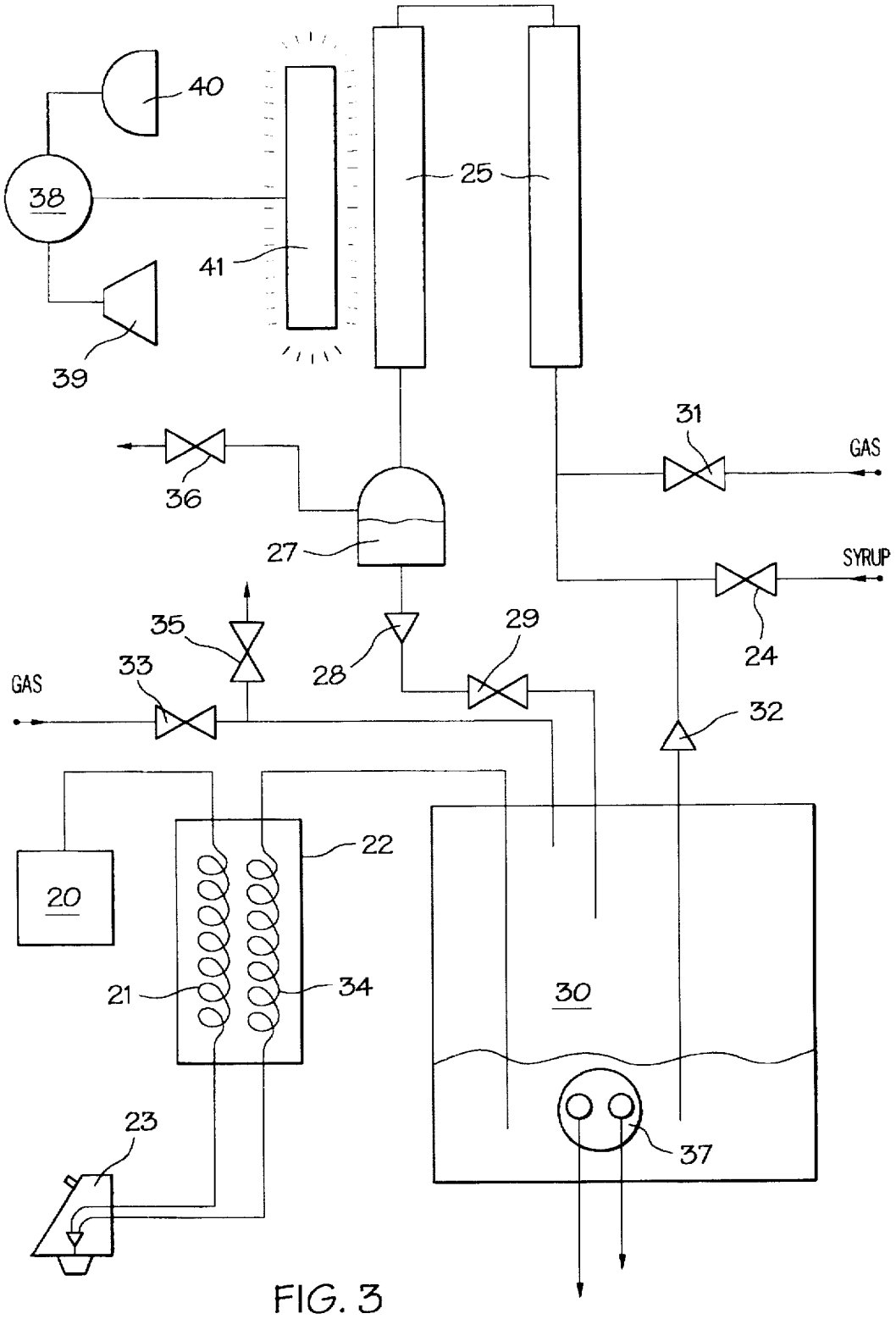
FIG. 3 is a schematic diagram showing the components and function of a fluid dispensing apparatus according to the invention.

A fluid dispensing apparatus according to the invention, see FIG. 3, is shown in detail. A source of carbonated water 20 is connected through a cooling pipe 21 within a refrigeration unit 22 to a dispensing valve 23. The water in the source 20 is maintained under sufficient pressure from a source of carbon dioxide gas, not shown, to ensure flow occurs when the valve 23 is operated. The dispensing valve 23 is, in effect, a mixing valve which dispenses and mixes carbonated water and a flavor syrup; such valves are known.

When the dispensing valve 23 is closed, the system needs recharging with syrup. This can be carried out by one of two methods. In the first method the source of flavored syrup from a tank, not shown, is supplied to the apparatus through a syrup supply control valve 24. The syrup flows to the display lines 25 and to a small holding tank 27. In the second method the syrup is directed to the lines 25 and into the tank 27 from the syrup supply reservoir 30 through a check valve 32 using gas pressure from the gas source through the valve 33. This will take place if there is sufficient syrup in the reservoir 30 to refill the lines 25. The presence of sufficient syrup in the reservoir 30 is determined by means of a sensor 37. Any residual gas pressure In the tank 27 and the reservoir can be removed by gas release valves 35 and 36.

It will be understood that by suitable sequencing of the opening and closing of the valves 24, 29, 31, 33, 35 and 36 samples of syrup can be directed to the dispensing valve 23 and through the lines 25. Syrup reaching the valve 23 is mixed with carbonated water and dispensed while that passing through the lines 25 is returned via the tank 27 to the syrup reservoir 30. The volume of syrup in the reservoir 30 is maintained at a pre-determined value by means of the liquid level sensor 37 and appropriate control systems which enable syrup to be supplied from the main tank.

Operation of the dispensing valve 23 supplies an electrical signal to a control unit 38 which causes one or more display devices to be activated. The control unit 38 can initiate an audio signal from a loudspeaker 29, a video display from a VDU 40 and/or an illuminated display from an illumination system 41. The illumination system is shown schematically as a linear source such as a gas discharge tube or a fluorescent tube. Other systems may be used such as incandescent lamps, LEDs or fibre optic illuminators. The connection to the control unit 38 is preferably by wire however the connections to the devices 39, 40 and 41 may be by fibre optic link, radio link or infrared ink.

While there are a variety of ways in which the dispensing apparatus can be controlled, in a preferred embodiment authorized operation of the dispenser valve 23 causes valve 31 to open. Prior to operation of the valve 23 the lines 25 are filled with syrup. Gas pressure through valve 31 drives the syrup through the lines 25 to the tank 27 from which it is released into the reservoir 30 through the check valve 28 and the syrup control valve 29 creating a syrup motion display. At the same time gas pressure through the valve 33 drives syrup from the reservoir 30 through the pipe 34 to the dispensing valve 23 where it is mixed with carbonated water and flows outwardly to a suitable container.

The gas pressure in the tank 27 is released by opening valve 36 to ensure there is no back pressure preventing the flow of syrup into the tank. Valve 36 is open to ensure there is no gas pressure opposing the syrup flow. The lines are now refilled and ready for the next dispensing cycle.

In preferred embodiments the dispenser valve 23 may be supplied by a plurality of syrup sources which can be preselected. A single source of carbonated water is used but each source of syrup has its own display lines so that an observer can see instantly from the color which type of beverage is being dispensed. Annunciator and display devices, activated by operation of the dispenser valve as described previously, can also identify the syrup.

Figure 4:
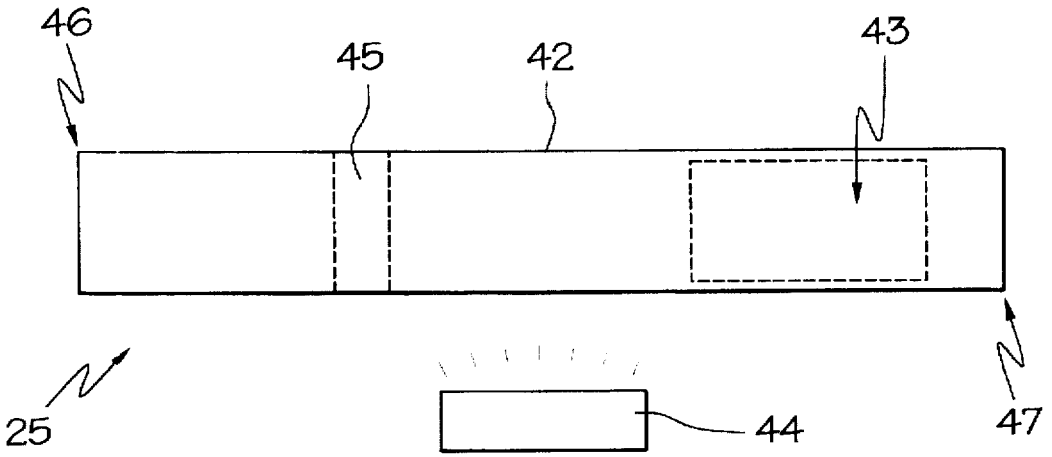
FIG. 4 is a schematic, block diagram representation of a display line of one embodiment of the present invention.

As shown in FIG. 4, a sample of syrup is directed through the display line 25 comprising a transparent or translucent tube 42. The tube surface may carry markings 43 such as pigmented stripes or embossed patterns. In many embodiments, the tube 42 may be illuminated. The flow of syrup sample can be made clearly visible by rear illumination of the tube 42 by a rear illumination source 44. Also, the flow of syrup sample can be made visible by fabricating the tube 42 with a contour 45 causing optical magnification of the contents when viewed externally. Illumination in the display line may also include a source of ultra-violet radiation to activate any flourescent components in the syrup sample, such as quinine in tonic water.

Figure 5:
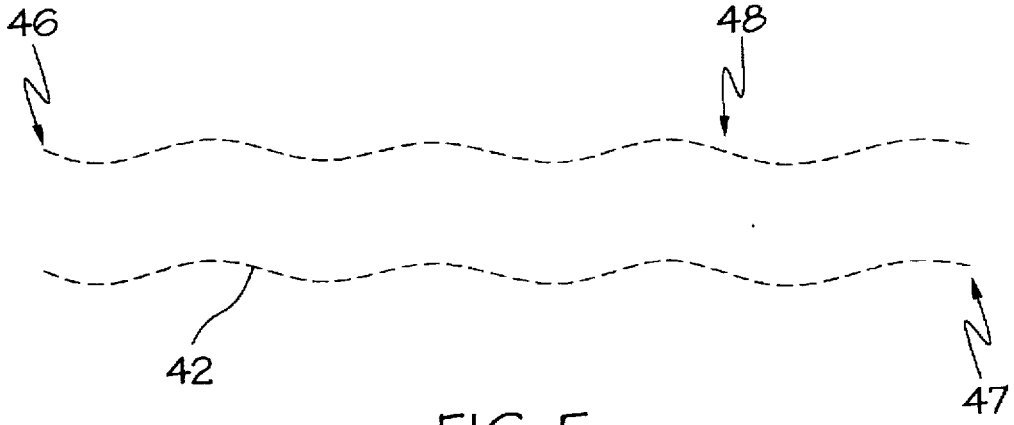
FIG. 5 is a schematic representation of a display line of another embodiment of the present invention.

The tube 42 preferably has a sufficiently small caliber such the syrup sample is seen as an elongate strip, which moves along the tube 42 from an issue point 46 to a reception point 47 when a beverage is dispensed. A linear tube may be used or, as shown in FIG. 5, the tube 42 may be disposed in a serpentine, zig zag or other tortuous path 48 to act as a focus of attention.

As discussed above, the apparatus is capable of supplying a variety of syrups, where there is a separate display dispense line 25 for each syrup to prevent cross contamination. The separate lines may be interwoven or cross each other to enhance the aesthetic effect.

In operation, the syrup sample is seen to flow from the issue point 46 to the reception point 47 where it disappears from view. Although a viewer may gain the impression that the sample seen is that included in the dispensed beverage, the displayed syrup sample may not be the sample being dispensed at the moment but may be a sample of a similar or identical syrup drawn from and, optionally, returned to the syrup reservoir 30 without reaching the dispensing nozzle.

While the invention has been described in detail and with reference to specific embodiments thereof, it will be apparent to one skilled in the art that various changes and modifications can be made therein without departing from the spirit and scope thereof.

What is claimed is:

1. A liquid dispensing apparatus comprising:

a source of carbonated water;

a source for the supply of one or more beverages in syrup form;

a mixer for the admixture of the carbonated water and syrup; and a display dispense line, positioned between an issue point and a reception point, comprising a transparent or translucent tube through which a flowing sample of syrup is directed from the issue point towards the reception point prior to admixture of the carbonated water and syrup;

wherein the tube has a sufficiently small caliber such that the sample of syrup is seen as an elongate strip moving along the tube from the issue point towards the reception point.

2. The apparatus of claim 1, wherein the tube includes markings or embossed patterns on a surface of the tube.

3. The apparatus of claim 1 wherein the tube is illuminated.

4. The apparatus of claim 2 wherein the tube is illuminated.

5. The apparatus of claim 4 further including sources of supply for a plurality of syrups and a corresponding plurality of display dispense lines, each display line comprising a transparent or translucent tube through which a flowing sample of the corresponding syrup is directed.

6. The apparatus of claim 5 wherein each tube is disposed in a serpentine path, a zig-zag path or another tortuous path.

7. The apparatus of claim 1 wherein the flowing sample of syrup is made clearly visible by rear illumination and/or fabricating each tube with a contour causing optical magnification of the contents.

8. The apparatus of claim 1 wherein the flowing sample syrup is not admixed with carbonated water when the apparatus performs a dispensing operation.

9. The apparatus of claim 8 wherein the flowing sample of syrup is a similar or identical syrup to that syrup admixed with the carbonated water and after being directed through the tube, is returned to a syrup reservoir.

10. The apparatus of claim 8 wherein the flowing sample of syrup is a highly colored or flourescent display syrup.

11. The apparatus of claim 1 further including sources of supply for a plurality of syrups and a corresponding plurality of display dispense lines, each display line comprising a transparent or translucent tube through which a flowing sample of the corresponding syrup is directed.

12. The apparatus of claim 1 wherein the tube is disposed in a serpentine path, a zig-zag path or another tortuous path.

13. The apparatus of claim 1 wherein the flowing sample of syrup is a highly colored or flourescent display syrup and is directed through the tube only and not admixed with carbonated water when the apparatus performs a dispensing operation.

14. A liquid dispensing apparatus comprising:

a source of carbonated water;

a plurality of syrup sources for the supply of one or more beverages in syrup form;

a mixer for the admixture of the carbonated water and syrup; and a plurality of display dispense lines comprising an illuminated, transparent or translucent tube, the tube including markings or embossed patterns thereon, the tube extending in a linear path, a serpentine path, a zig-zag path or another tortuous path, and the tube being fabricated with a contour causing optical magnification of contents of the tube;

wherein, prior to admixture of the carbonated water and one of the plurality of syrups, a sample of the directed through the tube;

wherein the sample is not admixed with the carbonated water when the apparatus performs a dispensing operation; and wherein the sample is similar or identical to the syrup, and after being directed through the tube, the sample is returned to a sample reservoir.

15. A liquid dispensing apparatus comprising:

a source of carbonated water;

a plurality of syrup sources for the supply of one or more beverages in syrup a mixer for the admixture of the carbonated water and syrup; and a plurality of display dispense lines comprising an illuminated, transparent or translucent tube, the tube including markings or embossed patterns thereon, the tube extending in a linear path, a serpentine path, a zig-zag path or another tortuous path, and the tube being fabricated with a contour causing optical magnification of contents of the tube;

wherein, prior to admixture of the carbonated water and one of the plurality of syrups, a sample of the syrup directed through the tube;

wherein the sample is not admixed with the carbonated water when the apparatus performs a dispensing operation; and wherein the sample is a highly colored or flourescent display syrup, and after being directed through the tube, the display syrup is returned to a display syrup reservoir.

* * * * *

UNITED STATES PATENT AND TRADEMARK OFFICE

CERTIFICATE OF CORRECTION

PATENT NO. : 5,730,330

DATED : March 24, 1998

INVENTOR(S) : Graeme John Reading

It is certified that error appears in the above-indentified patent and that said Letters Patent is hereby corrected as shown below:

On the title page, item [76],

Change Inventor's Address to --GB Crane Court, 45 Sassoon Road, Hong Kong--.

Signed and Sealed this

Twenty-first Day of July, 1998

*Attest:*

*Attesting Officer*

BRUCE LEHMAN

*Commissioner of Patents and Trademarks*